United States Patent [19]

Kopf

[11] Patent Number: 4,486,009

[45] Date of Patent: Dec. 4, 1984

[54] APPARATUS FOR COOLING SHEET METAL PANELS

[75] Inventor: Gerhard Kopf, Dillingen, Fed. Rep. of Germany

[73] Assignee: Aktien-Gesellschaft der Dillinger Hüttenwerks, Dillingen, Fed. Rep. of Germany

[21] Appl. No.: 475,853

[22] Filed: Mar. 16, 1983

[30] Foreign Application Priority Data

Mar. 18, 1982 [DE] Fed. Rep. of Germany ..... 3209875

[51] Int. Cl.[3] ..... C21D 9/46

[52] U.S. Cl. ..... 266/114; 266/259; 266/133; 266/134; 148/155

[58] Field of Search ..... 148/153, 155, 156; 266/259, 114, 117, 130, 133; 72/201; 62/63, 64

[56] References Cited

U.S. PATENT DOCUMENTS

| | | | |
|---|---|---|---|
| 3,546,911 | 12/1970 | Lenz | 266/117 |
| 3,604,696 | 9/1971 | Coleman et al. | 266/117 |
| 3,687,145 | 8/1972 | Schrader et al. | 266/114 |
| 3,792,844 | 2/1974 | Berry et al. | 266/117 |
| 3,885,581 | 5/1975 | Dahan et al. | 266/114 |
| 3,990,257 | 11/1976 | Taylor et al. | 266/114 |

FOREIGN PATENT DOCUMENTS

| | | | |
|---|---|---|---|
| 412259 | 6/1974 | U.S.S.R. | 266/111 |
| 292505 | 7/1979 | U.S.S.R. | 266/114 |
| 219607 | 9/1979 | U.S.S.R. | 266/114 |

*Primary Examiner*—L. Dewayne Rutledge
*Assistant Examiner*—Christopher W. Brody
*Attorney, Agent, or Firm*—Peter K. Kontler

[57] ABSTRACT

Apparatus for cooling sheet metal panels has an elongated channel bounded by two side walls, a longitudinally slotted top wall and a longitudinally slotted bottom wall. These walls are immersed in a liquid containing vessel and the latter contains sets of horizontal driven shafts above the top wall and below the bottom wall. The shafts carry disc-shaped transporting members, portions of which extend through the slots of the top and bottom walls to engage a panel which is introduced into the channel and to transport the panel toward the outlet of the channel. The top wall and the shafts above the top wall are movable up and down to provide room for panels of different thicknesses. Two nozzles discharge water into the inlet of the channel at a level above as well as at a level below the panel between the upper and lower transporting members.

25 Claims, 3 Drawing Figures

APPARATUS FOR COOLING SHEET METAL PANELS

BACKGROUND OF THE INVENTION

The present invention relates to apparatus for cooling panels, especially panels which consist of sheet metal. More particularly, the invention relates to improvements in apparatus of the type wherein successive panels must advance through a channel whose width slightly exceeds the width of a panel and whose height is only slightly more than the thickness of the panel therein.

It is already known to provide a panel cooling apparatus with means defining a relatively narrow channel whose height does not appreciably exceed the thickness of the panels and which is immersed in a vessel. A continuous stream of water or another coolant is conveyed from the inlet toward the outlet of the channel so that the coolant contacts both sides of the panel or panels in the channel. The means for advancing a panel through the channel comprises pairs of rollers which engage the panel from above and from below. The rollers are mounted in the vessel and extend through the top and bottom walls of the structure which defines the channel. An apparatus of such type is disclosed, for example, in German Offenlegungsschrift No. 2,414,445. The purpose of the apparatus is to effect uniform cooling of both sides of the panel which is caused to advance through the channel. Such apparatus constitutes an improvement over earlier apparatus which utilize means for spraying water against both sides of a panel or plate consisting of sheet metal or the like. The cooling action of these earlier apparatus is not entirely satisfactory because the droplets of water which are propelled against the underside of the panel rebound and immediately descend by gravity. On the other hand, the droplets which are sprayed onto the upper side of the panel remain on the panel to form thereon a pool or stream which flows toward and beyond the marginal portions of the panel to produce an additional cooling action. In other words, the cooling action of water sprays upon the upper side is much more pronounced than the cooling action at the underside of the panel. Reference may be had to German Pat. Nos. 1,508,386 and 2,245,390 which disclose such earlier types of cooling apparatus. The apparatus of German Pat. No. 1,508,386 uses rollers in the form of wheels with tires which permit the sprinkled-on water to flow laterally therebetween as well as in the longitudinal direction of the panel. German Pat. No. 2,245,390 discloses rollers with worm threads which also permit water to flow longitudinally of a moving panel as well as laterally and beyond the two marginal portions of the panel.

The apparatus which is disclosed in the aforementioned German Offenlegungsschrift No. 2,414,445 exhibits the drawback that it is difficult to seal the channel forming means at the two sides of the channel in such a way that the height of the channel can be altered, i.e., so as to allow for introduction of thicker or thinner panels. Moreover, the rollers in the channel offer a pronounced resistance to the flow of coolant in the longitudinal direction of the channel so that the admitted coolant must be injected at an elevated pressure with additional expenditures for energy and heavy duty pumps.

OBJECTS AND SUMMARY OF THE INVENTION

An object of the invention is to provide a novel and improved apparatus which is constructed and assembled in such a way that it ensures highly uniform cooling of both sides of each of a short or long series of successively treated panels.

Another object of the invention is to provide the apparatus with novel and improved panel transporting or advancing members which offer minimal resistance to the flow of coolant in the desired direction or directions.

A further object of the invention is to provide the apparatus with novel and improved means for defining a channel wherein the panels are treated by streams of water or another suitable coolant.

An additional object of the invention is to provide the apparatus with novel and improved means for changing the dimensions of the channel wherein the panels are treated with streams of water or the like.

Still another object of the invention is to provide an apparatus which can treat thick or thin, wide or narrow, long or short panels with the same degree of efficiency, which can treat both sides of each panel to the same extent, and wherein the panels can be treated by streams of a coolant whose pressure need not be pronounced in order to ensure uniform and predictable cooling of both sides of each and every portion of each panel.

An additional object of the invention is to provide a novel and improved method of advancing a succession of sheet metal panels or the like through a cooling zone.

Another object of the invention is to provide an apparatus which can be used as a simpler, more compact and more efficient substitute for the aforediscussed conventional apparatus and other types of heretofore known panel cooling apparatus.

A further object of the invention is to provide a novel and improved system for sealing the channel for panels from the surrounding area.

The invention is embodied in an apparatus for cooling panels, especially panels which consist of sheet metal. The apparatus comprises confining means defining a coolant-containing channel and having an inlet, and outlet, a top wall and a bottom wall. Each of these walls has a plurality of relatively narrow parallel slots, and the apparatus further comprises means for advancing the panels through the channel. The advancing means comprises a first set of disc-shaped transporting members having portions extending into the channel through the slots of the top wall, a second set of disc-shaped transporting members having portions extending into the channel through the slots of the bottom wall, and means for rotating at least some of at least one of the two sets of transporting members (e.g., all transporting members of the first set or all transporting members of the second set) so that a panel which is introduced through the inlet and between the aforementioned portions of the two sets of transporting members in the channel is advanced toward and beyond the outlet.

The apparatus further comprises a vessel for the confining means. Each set of transporting members preferably comprises several rows of coaxial transporting members and a shaft for each row. These shafts are disposed externally of the channel but in the interior of the vessel. The latter can be provided with a cover above the top wall of the confining means. The shafts can carry rollers for the transporting members, and the transporting members extend radially beyond the peripheral surfaces of the respective rollers and into and through the slots in the respective walls.

The apparatus preferably further comprises means for changing the level of the top wall and of the first set of transporting members in the interior of the vessel. Such level changing means is preferably designed to move the top wall and the first set of transporting members to a number of different positions corresponding to the anticipated number of different panels to be treated in the improved apparatus, i.e., panels having different thicknesses which can range between 5 mm and 80 mm or thereabout. The confining means further comprises stationary side walls which extend between the top and bottom walls and flank the path of panels in the channel. The side walls have elongated vertically extending openings for the shafts which carry the rows of transporting members constituting the first set, and the confining means then further comprises means for sealing the openings in the side walls irrespective of the selected level of the top wall and of the first set of transporting members. Such sealing means can comprise suitable bellows or the like.

The apparatus further comprises first and second coolant admitting nozzles which respectively discharge into the inlet at a level above and at a level below the panel which is engaged and advanced by the transporting members. The nozzles are preferably provided with narrow slit-shaped coolant-discharging openings which extend at least substantially transversely of the channel. Furthermore, each nozzle preferably comprises a first resilient section (e.g., a leaf spring) bearing against the panel which is introduced between the nozzles, and a second resilient section (e.g., a second leaf spring) which is preferably parallel to the respective first section and defines therewith a compartment for a fluid discharging device serving to direct a jet of cleaning or drying fluid against the respective side of a panel between the nozzles. Such jets are preferably directed substantially transversely of the direction of transport of panels through the channel.

The transporting members of the aforementioned rows in the first and/or second set are preferably staggered relative to each other, as considered in the axial direction of the aforementioned shafts, i.e., as considered transversely of the direction of travel of panels through the channel.

The rotating means can comprise discrete first and second prime movers for the respective sets of transporting members, and eccentric couplings or clutches between the first prime movers and the respective shafts in order to enable such shafts to share the movements of the top wall to different levels relative to the bottom wall of the confining means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
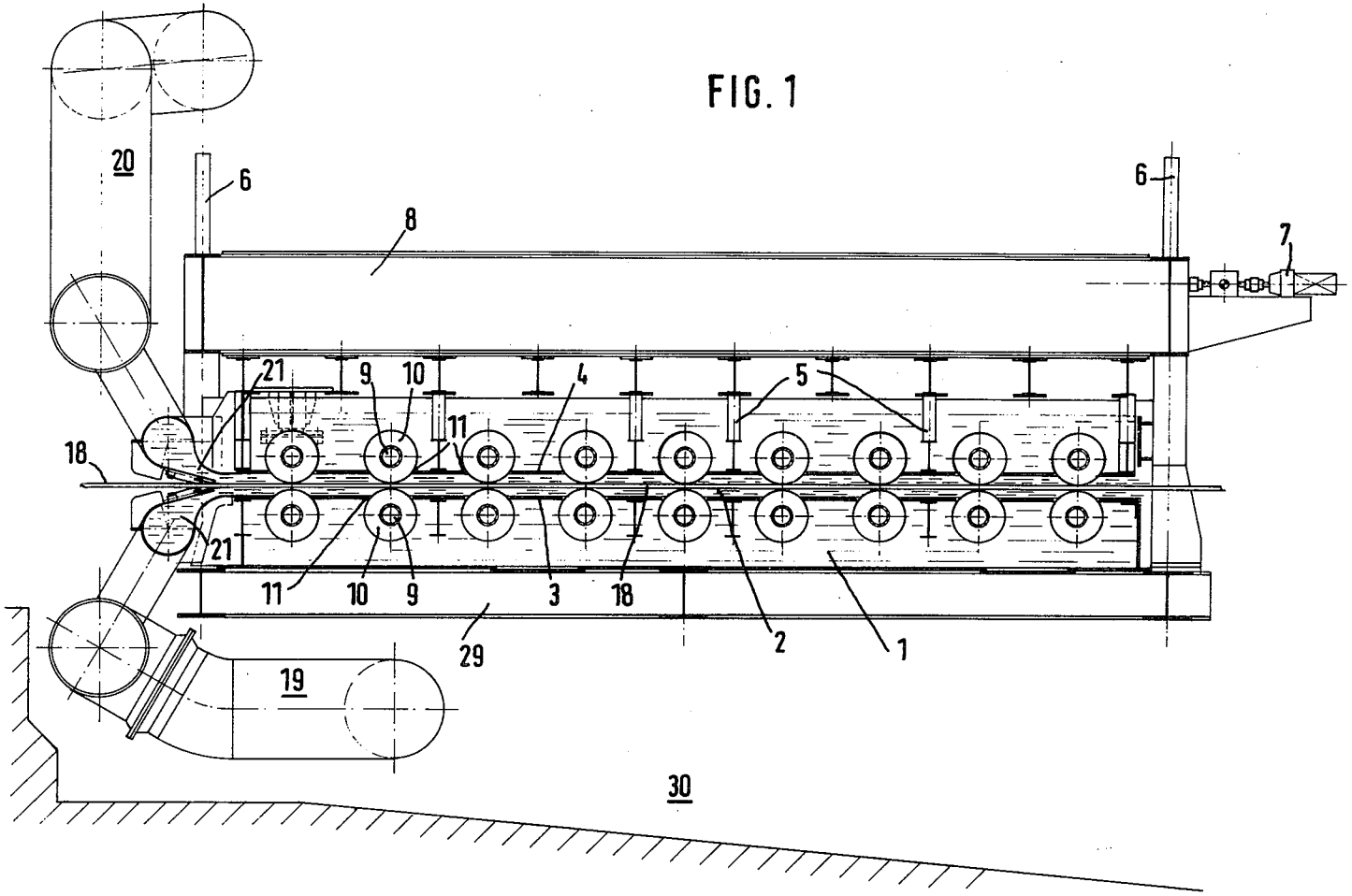
FIG. 1 is a longitudinal vertical sectional view of an apparatus which embodies one form of the invention.

The apparatus which is shown in the drawing comprises a water-containing vessel 1 having for example a length of 6 meters, a width of 3.5 meters, and a height of 1 meter. The vessel 1 contains a confining unit including a horizontal bottom wall 3, a horizontal top wall 4 and two upright side walls 40, 41. These walls define an elongated horizontal channel 2 whose inlet is located at the left-hand side and whose outlet is located at the right-hand side of FIG. 1. The bottom wall 3 and the side walls 40, 41 are or can be fixedly mounted in the interior of the vessel 1. On the other hand, the top wall 4 is movable up and down through a distance of a few centimeters and, to this end, is suspended on several upright carriers 5 extending downwardly from a horizontal beam 8 which is reciprocable along upright columns 6 by suitable drive means 7. The purpose of the movable top wall 4 is to conform the height of the channel 2 to the thickness of a panel 18 which is caused to advance through the channel and to be thereby treated by the body of water which fills the channel while the apparatus is in use.

Figure 2:
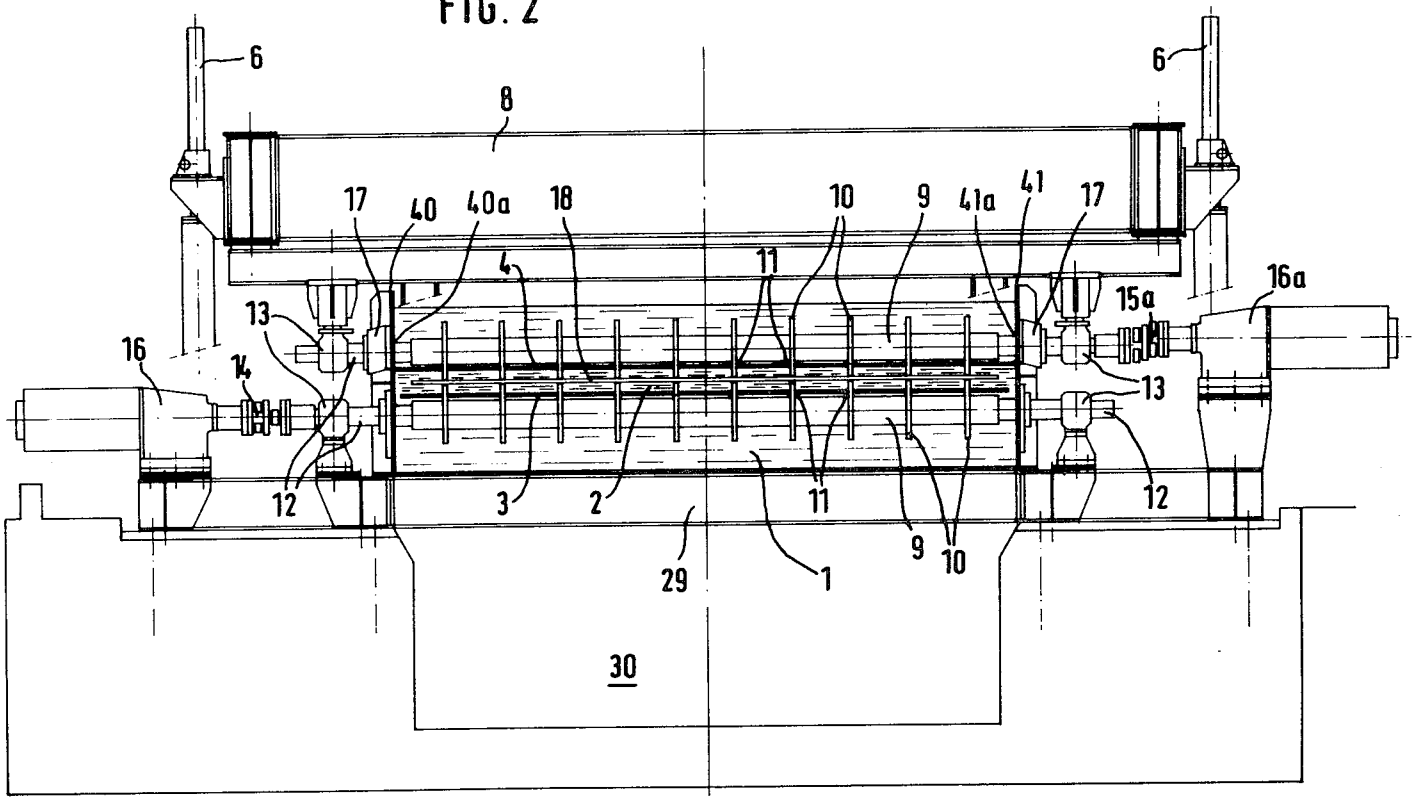
FIG. 2 is a transverse vertical sectional view of the apparatus which is shown in FIG. 1.

The means for advancing the panel 18, or a succession of panels, through the channel 2 comprises two sets of disc-shaped transporting members 10 having portions extending into the channel 2 through elongated narrow slots 11 which are respectively provided therefor in the bottom wall 3 and top wall 4. The upper set of transporting members 10 forms several parallel rows which extend transversely of the channel 2, i.e., transversely of the direction of advancement of panels 18 through the apparatus, and the lower set of transporting members 10 also forms several rows which are parallel to the rows of upper members 10. Each lower row is disposed at a level below or in line with one of the upper rows. Those portions of the transporting members 10 which extend into the channel 2 engage the respective sides of the panel 18 between the walls 3, 4 and advance the panel in a direction to the right, as viewed in FIG. 1. The transporting members 10 of the rows above and of the rows below the channel 2 are preferably staggered with reference to one another, as considered in the axial direction of these members. For example, the distribution of each and every row of transporting members 10, as considered at right angles to the plane of FIG. 1, can be different from that in the neighboring row or rows at the same side or at the opposite side of the channel 2. The transporting members 10 are mounted on rollers 9 each of which supports a row of such members (note FIG. 2) and each of which is located in the vessel 1 above the top wall 4 or below the bottom wall 3. The shafts 12 for the rollers 9 extend through suitable openings in the side walls 40, 41 of the confining unit which defines the channel 2. Those end portions of the shafts 12 which extend beyond the respective side walls 40, 41 are rotatable in suitable bearings 13. The upper bearings 13 are mounted at the underside of the beam 8, and the lower bearings 13 are mounted in the frame 29 of the apparatus. Thus, the upper bearings 13 share the movements of the top wall 4 and of the upper set of transporting members 10 with reference to the bottom wall 3. The shafts 12 for the lower set of transporting members 10 are driven by prime movers 16 which are fixedly mounted in the frame 29, and the shafts 12 of the upper set of members 10 are driven by prime movers 16*a* which are also mounted in the frame 29. The output shafts of the prime movers 16 for the lower members 10 transmit torque to the respective shafts 12 by way of clutches 14, and the output shafts of the prime movers 16*a* transmit torque to the respective upper shafts 12 by way of eccentric clutches or couplings 15*a* (e.g., cardan joints) which allow the shafts 12 of the upper set to share the movements of the beam 8 along the columns 6. The openings 40*a* and 41*a* which are provided in the side walls 40, 41 for the upper shafts 12 are elongated or sufficiently large to allow for upward and downward movements of such shafts with the beam 8. These openings are sealed by deformable bellows 17 to prevent uncontrolled escape of water from the channel 2.

Figure 3:
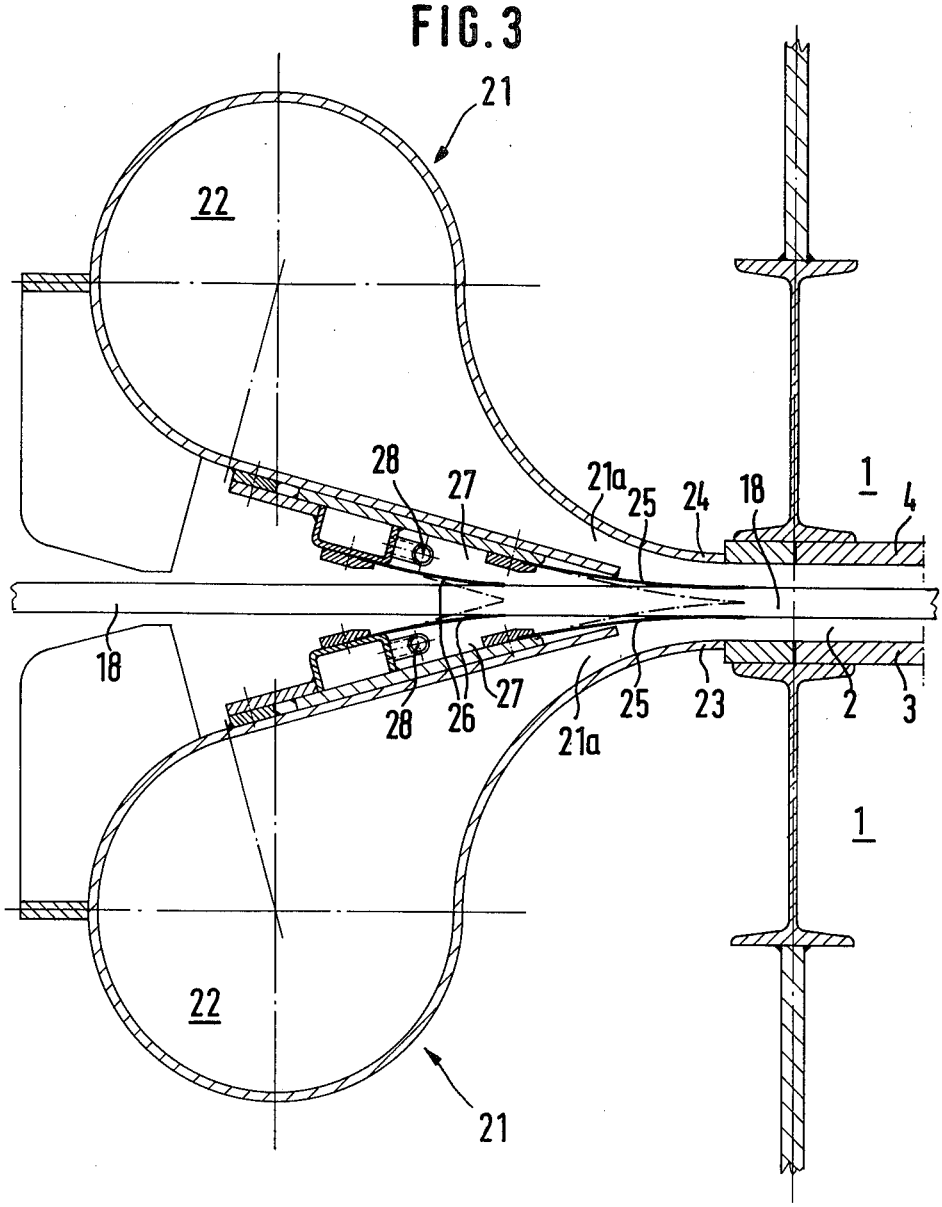
FIG. 3 is an enlarged view of a detail in the apparatus of FIG. 1.

The inlet of the channel 2 receives liquid coolant from two nozzles 21 which are shown in greater detail in FIG. 3. These nozzles have relatively narrow discharge openings 21*a* which extend transversely of the channel 2 are respectively disposed at the upper side and at the underside of the panel 18 which is introduced between the two nozzles 21 to be engaged and entrained by the transporting members 10. Each of the nozzles 21 further comprises a first or front resilient biasing section 25 in the form of a leaf spring which bears against the respective side of the panel 18 between the two nozzles. Still further, each of the nozzles 21 comprises a second or rear resilient biasing section in the form of a leaf spring 26 which is disposed upstream of the respective section 25, which is parallel to the respective section 25, and which defines with the respective section 25 a compartment 27 accommodating a fluid discharging device or nozzle 28 arranged to discharge a jet of fluid substantially transversely of the channel 2, i.e., substantially transversely of the direction of movement of panels 18 through the apparatus. It will be noted that each of the two nozzles 21 comprises a relatively large rear portion 22 which extends transversely of the channel 2 and receives water from a tank 30, as well as a forwardly tapering portion defining the respective opening 21*a*. The upper boundary 24 of the discharge end of the upper nozzle 21 is flush with the top wall 4, and the lower boundary 23 of the discharge end of the lower nozzle 21 is flush with the bottom wall 3. The boundary 24 can move up and down with the wall 4.

The frame 29 of the apparatus is installed at a level above the tank 30 which receives water from the outlet of the channel 2 and from which the intakes 19 and 20 of the two nozzles 21 draw water for introduction into the inlet of the channel 2.

The operation is as follows:

The drive means 7 is started to move the beam 8 and hence to the top wall 4 and the upper set of shafts 12 to a desired level, depending upon the thickness of the panels 18 which are to be cooled in the channel 2. The selected height of the channel 2 equals the thickness of a panel 18 plus the extent to which portions of the upper set of transporting members 10 extend downwardly beyond the underside of the top wall 4 plus the extent to which portions of the lower set of the transporting members 10 extend upwardly beyond the upper side of the bottom wall 3. For example, if the thickness of a panel 18, which is about to be introduced between the upper and lower transporting members 10 is 5 mm and the distance through which the transporting members extend into the channel 2 is 20 mm, the selected height of the channel 2 will be 45 mm. As a rule, the thickness of the panels 18 which are to be treated in the apparatus of the present invention is between approximately 5 and 80 mm, i.e., the height of the channel 2 is expected to be varied between 45 and 120 mm.

An oncoming panel 18 enters first between the upstream leaf springs 26, thereupon between the downstream leaf springs 25, and its leader thereupon enters the channel 2 where it is engaged by the transporting elements 10 so that it advances toward and beyond the outlet. The slots 11 in the walls 3 and 4 are just wide and long enough to permit the passage of portions of the respective transporting members 10. The transporting members 10 ensure that the panel 18 is maintained at the center of the channel 2, i.e., at a level at least substantially midway between the walls 3 and 4. The point contact between a relatively large number of upper transporting members 10 and the upper side of the panel 18, as well as between a relatively large number of lower transporting members 10 and the underside of the panel suffices to ensure predictable advancement of the panel through the channel 2. The arrangement may be such that the weight of the upper transporting members 10, of the upper shafts 12 and of the beam 8 rests on the panel 18 in the channel 2 to ensure predictable advancement of the panel toward and beyond the outlet.

The nozzles 21 receive water through the respective intakes 19 and 20 which draw water from the tank 30 under the action of suitable pumps, not shown. The streams of water which issue from the nozzles 21 are independent of each other but are at least substantially identical. Moreover, the height of the channel portion between a panel 18 and the top wall 4 is at least substantially identical with the height of the channel portion between the underside of the panel and the bottom wall 3 so that the cooling action upon both sides of a panel in the channel 2 is at least substantially identical. This holds true irrespective of the thickness of the treated panel since the distance between the walls 3 and 4 is adjustable in the aforediscussed manner so that the spacing between the lowermost portions of the upper transporting members 10 and the topmost portions of the lower transporting members 10 always matches or closely approximates the thickness of the treated panel.

As the nozzles 21 deliver water into the inlet of the channel 2, some water penetrates into the vessel 1 and the water level in this vessel rises until the static pressure of water above the top wall 4 matches the pressure of inflowing water. The water which issues at the outlet of the channel 2 descends into the tank 30 and is recirculated into the nozzles 21 for renewed introduction into the channel 2. In order to reduce the likelihood of nonuniform cooling of both sides of the panel 18 which leaves the channel 2, the apparatus can be equipped with brushes or other wiping means which sweep away the liquid from the upper sides of successive increments of a panel which advances beyond the outlet of the channel 2. This ensures that the upper side of the panel is not cooled more thoroughly than the underside. The just mentioned brushes or strips of sweeping material can be replaced by one or more nozzles which blow a gaseous medium against the upper side of the panel to remove the water layer therefrom.

In order to conform the cooling action to the thicknesses of the panels 18, the prime movers 16 and 16*a* are preferably variable-speed electric motors or the like which can drive the respective shafts 12 at a number of different speeds. This renders it possible to reduce the speed of transport of a relatively thick panel and to transport a relatively thin panel at a higher speed. If the apparatus cannot adequately cool a relatively thick panel, e.g., a panel whose thickness approximates or even exceeds 80 mm, the illustrated apparatus can be followed by a second apparatus of similar or identical design and/or by an apparatus which sprays a liquid coolant against the two sides of a relatively thick panel downstream of the channel 2.

An important advantage of the improved apparatus is that the disc-shaped transporting members 10 offer little resistance to the flow of liquid coolant in the longitudinal direction of the channel 2 because their thickness (as considered in the axial direction of the respective shafts 12) is minimal or negligible. Therefore, the nozzles 21 can supply coolant at a relatively low pressure because such coolant encounters little resistance to flow in and through the channel 2. An additional advantage of the improved apparatus is that the rate of escape of coolant from the channel 2 at locations other than via outlet is a small fraction of the rate of escape of coolant from the channels of conventional apparatus. This is also attributable to the provision of disc-shaped transporting members 10, i.e., the width of slots 11 in the walls 3 and 4 is small or very small so that the quantity of coolant which flows from the channel 2, through the slots 11 and into the vessel 1 is small or extremely small. In other words, the admitted coolant is confined to flow in the channel 2, and such flow is practically unobstructed because the resistance of the thin disc-shaped transporting members 10 is minimal. The body of coolant in the vessel 1 merely serves to produce a requisite static pressure which prevents the flowing coolant from leaving the channel 2 via slots 11 as soon as the liquid in the vessel 1 rises to a predetermined level. It has been found that the pressure of liquid coolant which is admitted via nozzles 21 can be reduced to a minute fraction of the pressure of coolant in conventional cooling apparatus without in any way affecting the cooling and heat removing action. Consequently, and since the problems with sealing of the confining means against uncontrolled escape of coolant are directly proportional to the pressure of conveyed coolant, such sealing problems in the apparatus of the present invention are negligible since the pressure of the admitted coolant is low for reasons which were explained above. Still further, the improved apparatus can employ a relatively simple and lightweight arrangement for changing the level of the top wall 4 and of the shafts 12 above the top wall because such arrangement need not stand pronounced pressures. The beam 8 can be said to constitute a cover for the vessel 1. Another important advantage of the improved apparatus is that the treated panels are subjected to negligible deforming or distorting stresses, again because the pressure of liquid coolant is only a small fraction of the pressure which is applied in conventional cooling apparatus for panels of sheet metal or the like.

The feature that the apparatus can operate with coolant which is maintained at a surprisingly low pressure contributes to overall simplicity of the apparatus, not only as concerns the weight, bulk and cost of the means for moving the top wall 4 up and down but also as concerns the construction and mounting of the confining unit including the walls 3, 4, 40 and 41. Such unit can be installed in the interior of the vessel 1 and its walls need not be made of extra thick or sturdy material. Simple bellows (17) can be used to seal the openings 40*a* and 41*a* through which the upper shafts 12 extend beyond the respective side walls 40, 41 of the confining unit.

The aforedescribed nozzles 21 exhibit the advantage that their narrow slit-shaped openings 21*a* convert the admitted liquid coolant into two discrete streams whose cross-section matches or closely approximates that of the streams which flow in the channel 2 above and below a panel 18 which is advanced by the transporting members 10. Moreover, the boundaries 23, 24 of the nozzles 21 cooperate with the respective leaf springs 25 to ensure that the streams of liquid coolant which leave the nozzles 21 flow in a direction which deviates only negligibly from the direction of coolant flow in the channel 2. This reduces the likelihood of turbulence and contributes to predictable cooling action of the admitted liquid medium.

The purpose of the fluid discharging devices 28 in the compartments 27 of the nozzles 21 is to keep the respective sides of a panel 18 ahead of the leaf springs 25 free of coolant and to thus further enhance the likelihood of predictable cooling action. The compartments 27 gather or would be likely to gather coolant which invariably seeps or is highly likely to seep behind the first leaf springs 25. Thus, the devices 28 ensure that the actual cooling action begins only downstream of the leaf springs 25, even if some coolant is likely to leak into the compartments 27 when the apparatus is in use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for cooling panels, particularly panels which consist of sheet metal, comprising confining means defining a coolant-containing channel and having an inlet, an outlet, a top wall and a bottom wall, each of said walls having a plurality of relatively narrow slots; means for advancing the panels through said channel, including a first set of disc-shaped transporting members having portions extending into the channel through the slots of the top wall, a second set of disc-shaped transporting members having portions extending into the channel through the slots of the bottom wall, and means for rotating at least some transporting members of at least one of said sets so that a panel which is introduced through the inlet and between said portions of the two sets of transporting members in said channel is advanced toward and beyond said outlet, said confining means further having side walls extending between said top and bottom walls and flanking the path of panels between said portions of the two sets of transporting members in said channel; a coolant-containing vessel for said confining means and said transporting members, each of said sets comprising several rows of coaxial transporting members and a shaft for each of said rows, said shafts being disposed externally of said channel in the interior of said vessel and said advancing means further comprising rollers mounted on said shafts, said transporting members extending radially beyond the respective rollers and into and through the slots of the respective walls of said confining means, said side walls having openings for the shafts carrying the transporting members of said first set and bellows for sealing said openings, said bellows being arranged to permit substantially vertical movements of the respective shafts with reference to said bottom wall; a cover for said vessel at a level above said top wall; and means for changing the level of said top wall and of the first set of transporting members in the interior of said vessel.

2. The apparatus of claim 1, further comprising first and second coolant admitting nozzles respectively discharging into said inlet at a level above and at a level below the panel which is engaged and advanced by said transporting members.

3. The apparatus of claim 2, wherein said nozzles have narrow slit-shaped coolant-discharging openings extending substantially transversely of said channel.

4. The apparatus of claim 3, wherein each of said nozzles includes a first resilient section bearing against the panel which is introduced between said nozzles.

5. The apparatus of claim 4, wherein said resilient sections include leaf springs.

6. The apparatus of claim 4, wherein each of said nozzles further comprises a second resilient section located upstream of the respective first section, as considered in the direction of advancement of panels from said inlet toward said outlet, said second sections bearing against the respective sides of the panel between said nozzles.

7. The apparatus of claim 6, wherein the second sections of said nozzles are substantially parallel to the respective first sections.

8. The apparatus of claim 6, wherein each of said second sections and the respective first section define a compartment and further comprising fluid discharging means provided in said compartments and arranged to direct jets of a fluid against the respective sides of a panel between said nozzles.

9. The apparatus of claim 8, wherein said fluid discharging means are arranged to direct the jets substantially transversely of the direction of transport of panels in said channel.

10. The apparatus of claim 1, wherein each of said sets comprises several rows of coaxial transporting members and a discrete shaft for each of said rows, said shafts extending transversely of the direction of travel of panels through said channel and the transporting members of at least some of said rows being staggered with reference to each other, as considered in the axial direction of the respective shafts.

11. The apparatus of claim 1, wherein all of said slots are parallel to each other.

12. The apparatus of claim 1, wherein said rotating means comprises discrete first and second prime movers for the transporting members of the respective sets.

13. The apparatus of claim 12, further comprising eccentric clutches interposed between the first prime movers and the first set of transporting members, and means for moving said top wall and said first set of transporting members up and down relative to said prime movers and said bottom wall.

14. Apparatus for cooling panels, particularly panels which consist of sheet metal, comprising confining means defining a coolant-containing substantially horizontal channel and having an inlet and an outlet; means for advancing the panels through said channel; and upper and lower coolant-admitting nozzles respectively discharging into said inlet at a level above and at a level below the panel which is transported by said advancing means, said nozzles having narrow openings which convert the admitted liquid coolant into discrete streams whose crosssection at least approximates that of the coolant in said channel above and below the panel which is transported by said advancing means, each of said nozzles having a resilient section lying flat against the respective side of the panel which is introduced between said nozzles so as to effect the flow of the respective stream substantially in the direction of coolant flow in said channel and to thus reduce or eliminate turbulence in the region where the respective stream contacts the panel between said nozzles and enhance the predictability of cooling action of the respective stream.

15. The apparatus of claim 14, wherein said resilient means include leaf springs.

16. The apparatus of claim 14, wherein each of said nozzles comprises a relatively large rear portion arranged to supply liquid coolant to the respective opening.

17. The apparatus of claim 16, wherein said rear portions extend transversely of said channel.

18. The apparatus of claim 16, wherein each of said nozzles tapers gradually from the respective rear portion toward the respective opening.

19. The apparatus of claim 16, wherein each of said rear portions has an at least partially circular cross-sectional outline.

20. The apparatus of claim 14, wherein said confining means includes a top wall above and a bottom wall below said channel, said upper nozzle having a portion terminating at said top wall and said lower nozzle having a portion terminating at said bottom wall.

21. The apparatus of claim 14, wherein said confining means includes a top wall above and a bottom wall below said channel, said upper nozzle having a portion merging gradually into said top wall and said lower nozzle having a portion merging gradually into said bottom wall.

22. The apparatus of claim 14, wherein each of said nozzles further comprises a second resilient section located upstream of the respective first resilient section, as considered in the direction of advancement of panels from said inlet toward said outlet, said second resilient sections bearing against the respective sides of the panel between said nozzles.

23. The apparatus of claim 22, wherein the second sections of said nozzles are substantially parallel to the respective first sections.

24. The apparatus of claim 22, wherein each of said second sections and the respective first section define a compartment and further comprising fluid discharging means provided in said compartments and arranged to direct jets of a fluid against the respective sides of a panel between said nozzles.

25. The apparatus of claim 24, wherein said fluid discharging means are arranged to direct the jets substantially transversely of the direction of transport of panels in said channel.

* * * * *